US005168927A

United States Patent [19]

Stegemeier et al.

[11] Patent Number: 5,168,927

[45] Date of Patent: Dec. 8, 1992

[54] METHOD UTILIZING SPOT TRACER INJECTION AND PRODUCTION INDUCED TRANSPORT FOR MEASUREMENT OF RESIDUAL OIL SATURATION

[75] Inventors: George L. Stegemeier, Houston, Tex.; George E. Perry, New Orleans, La.

[73] Assignee: Shell Oil Company, Houston, Tex.

[21] Appl. No.: 757,386

[22] Filed: Sep. 10, 1991

[51] Int. Cl.[5] ..... E21B 47/00

[52] U.S. Cl. ..... 166/252; 166/250; 166/263; 73/155; 436/27; 436/29

[58] Field of Search ..... 166/250, 252, 263, 285; 436/27, 28, 29; 73/155

[56] References Cited

U.S. PATENT DOCUMENTS

| | | | |
|---|---|---|---|
| 2,578,500 | 12/1951 | Bernard et al. | 436/27 |
| 3,338,095 | 8/1967 | Johnson et al. | 166/252 |
| 3,590,923 | 7/1971 | Cooke, Jr. | 166/252 |
| 3,623,842 | 11/1971 | Deans | 166/252 X |
| 3,751,226 | 8/1973 | Hesse et al. . | |
| 3,799,261 | 3/1974 | Deans et al. | 436/27 X |
| 3,856,468 | 12/1974 | Keller | 166/252 X |
| 4,166,504 | 9/1979 | Brown et al. | 166/274 X |
| 4,182,416 | 1/1980 | Trantham et al. | 166/252 X |
| 4,617,994 | 10/1986 | Richardson | 166/250 |
| 4,646,832 | 3/1987 | Richardson | 166/250 |
| 4,722,394 | 2/1988 | Wellington et al. | 166/250 |
| 4,782,898 | 11/1988 | Wellington et al. | 166/252 |

*Primary Examiner*—George A. Suchfield
*Attorney, Agent, or Firm*—Del S. Christensen

[57] ABSTRACT

A method is disclosed for providing sharp breakthrough of tracers in a two-well tracer test by injecting a relatively small volume of tracer at a high rate into a temporary injection well, and utilizing the flow induced by producing wells to transport the tracers across the formation to a producing well. Measurement of residual oil saturation and sweep can be obtained by this method.

10 Claims, 2 Drawing Sheets

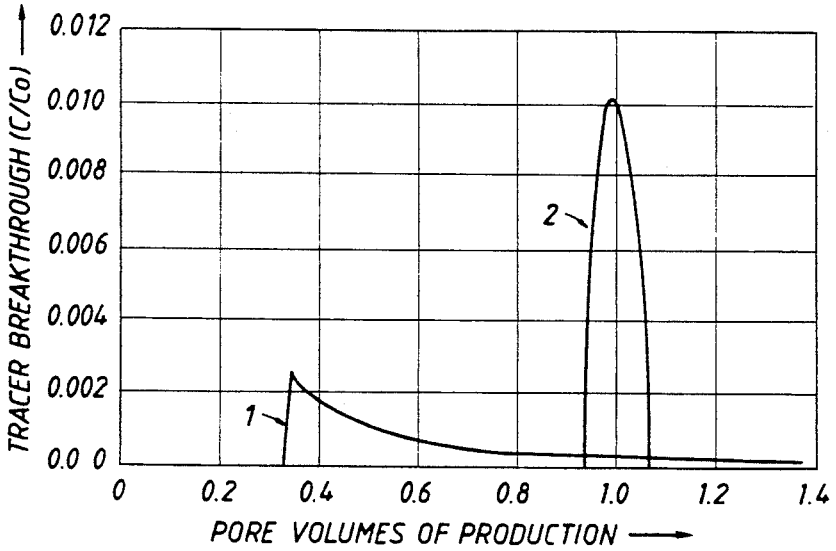
FIG. 1
FIG. 2
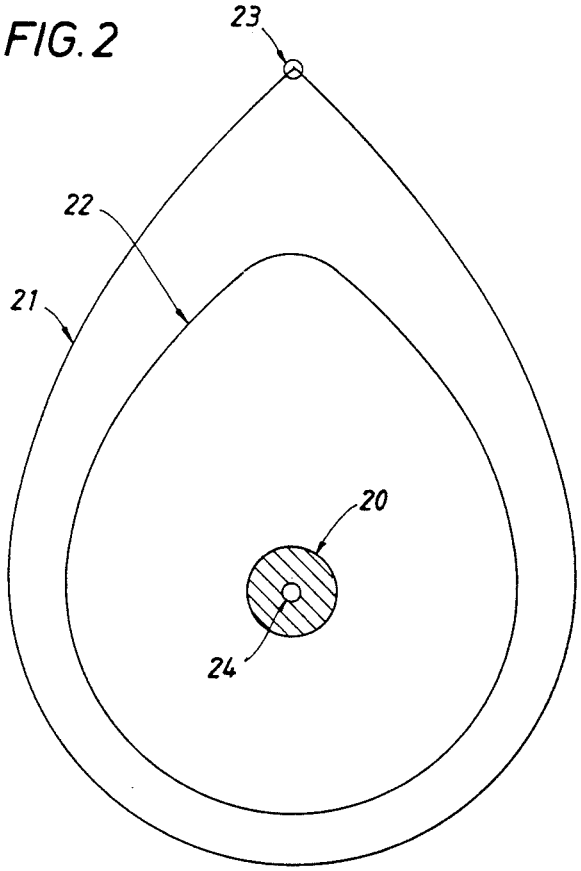
FIG. 3
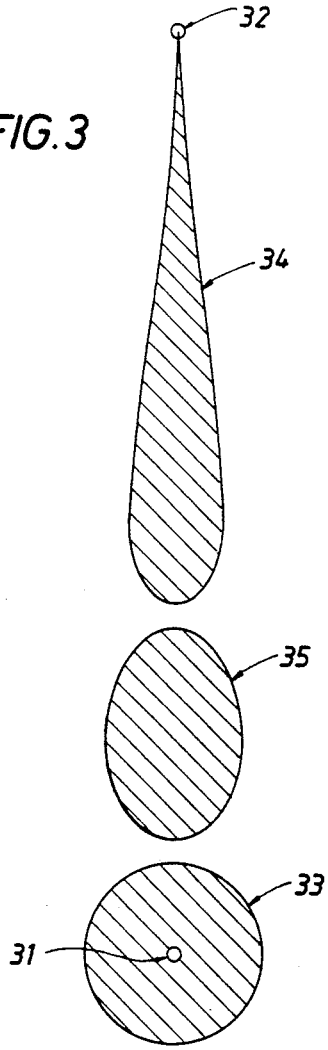

METHOD UTILIZING SPOT TRACER INJECTION AND PRODUCTION INDUCED TRANSPORT FOR MEASUREMENT OF RESIDUAL OIL SATURATION

FIELD OF THE INVENTION

This invention relates to a method for placement and capture of a tracer to measure reservoir properties.

BACKGROUND OF THE INVENTION

Tracer methods are frequently employed to observe the flow of fluids in subterranean geologic formations and to measure fluid content and other properties of these formations. Previous practice in the use of tracers have generally involved either single well or interwell tests. In the single well method, the tracer is injected into a well and then recovered by backflow into the same well. In the interwell method, the tracer is injected into the inflow stream of an injection well and is driven to a producing well (or wells) where it is captured. Tracer methods such as these are frequently used in oil field reservoirs to evaluate the connectivity of well pairs, to observe directional permeability, to determine fluid saturations, and to assess the flooding efficiency of oil recovery processes.

Typically, an oil-productive formation is a stratum of rock containing small interconnected pore spaces which are saturated with oil, water, and/or gas. As fluids are produced from such a formation, the oil can adhere to the rock surfaces or be trapped in the pore spaces. In either case the water becomes the more mobile phase. Hydrocarbons produced into wellbores by primary drive mechanisms are often replaced with indigenous brine which flows from expanding aquifers down-dip of producing well boreholes toward the producing wells. Hydrocarbons can also be recovered by secondary drive mechanisms such as water flooding. In a water flood, injected water displaces the reservoir fluids into the producing wellbores. Regardless of the source of the water, much of the pore space is eventually filled with a continuous brine phase. A reservoir in this condition is referred to as a watered-out reservoir. Additional oil can be recovered from such a reservoir, but, being almost immobile, it is produced with large volumes of water. Ultimately the production of oil from high water cut wells becomes uneconomical and continued economical production of oil may then require application of another oil recovery method. In planning these processes, knowledge of the amount of oil remaining in the formation is a critical factor that is needed to evaluate economics of the various secondary and tertiary oil recovery methods.

Various methods to determine residual oil saturation in such a formation are known, but each has drawbacks and limitations. One frequently used way to determine residual oil saturation is to drill a rock sample core from the formation and determine the oil content of the rock sample. This method is susceptible to faults of the sampling technique because the necessarily small sample that can be taken may not be representative of the formation as a whole. Also, there is a genuine possibility that the coring process itself may change the fluid saturation by flushing the recovered core. Moreover, coring can only be employed in newly drilled wells or by expensive sidetrack operations. Since the vast majority of wells have casing set through the oil-bearing formation when the well is initially completed, core samples are seldom recovered from existing wells.

Another approach for obtaining reservoir fluid saturations is by logging techniques. These techniques investigate a somewhat larger sample of the formation rock, but still are limited to the region relatively close to the wellbore. Fluid invasion into this region during drilling and completion prior to logging complicates quantitative measurement of fluid saturation. In addition, rapid changes in formation properties with depth often affect the log interpretation. Since logging methods measure the rock fluid system as an entity, it is often difficult to differentiate between mineralogical and fluid properties.

Material balance calculations based on production history are still another way to estimate remaining oil. Estimates of fluid saturation acquired by this method are subject to even more variability than coring or logging. This technique requires knowledge, by other methods, of the initial fluid saturation of the formation and the sweep efficiency of the encroaching fluids.

To overcome some of these shortcomings, tracer tests have been developed that utilize principles of chromatography to determine residual oil saturation from the separation of water-soluble-only tracers and oil-water partitioning tracers during their passage through the reservoir formation. U.S. Pat. No. 3,590,923 discloses such a process. In this process, an aqueous solution comprising the water-soluble tracer, and the partitioning tracer is injected in an injection well, and then is driven to a production well by injection of brine. The amounts of fluids produced before each of the tracers is detected, together with the partition coefficient of the partly oil-soluble tracer, are used to indicate the formation residual oil saturation. Driving the tracers from the injection wellbore initially forces the tracers out radially, so that, in reasonable times, the producing well will capture only a small fraction of the injected tracers. Large amounts of tracers must therefore be injected. Further, if the field is not already being subjected to a water flood, large volumes of brine must be provided to inject and drive the tracers. When the formation is not being subjected to a water flood, the cost of installing water injection facilities and of injecting brine is typically prohibitive. When a watered-out formation is not being subjected to a flood, methods are available which utilize chromatographic separation of tracers, first by injection of multiple tracer precursers into a well, reaction of at least one precurser into a partitioning tracer or a water soluble tracer, and then by backflow production from the same well. These methods are referred to as single well tracer tests. Such methods are disclosed in, for example, U.S. Pat. Nos. 3,623,842, 3,751,226, 3,856,468, 4,617,994, 4,646,832, 4,722,394, and 4,782,898. These methods have drawbacks which include: (1) difficulty of controlling the reaction when an injected precursor is used to generate a tracer within the formation; (2) differences in flow profiles between the injection and production periods; (3) crossflow of fluids between vertical layers; (4) the need to dedicate a well to such a test for an extended time period; and (5) sampling only a limited portion of the formation.

It is therefore an object of this invention to provide a more efficient method of capturing tracer at a producing well in the measurement of the residual oil saturation of an oil-producing formation. It is a further object to provide a method to determine the residual oil saturation over a significant portion of the formation, wherein water flooding is not needed, and wherein normal production is maintained throughout the test.

SUMMARY OF THE INVENTION

These and other objects are accomplished by a method comprising the steps of: (1) injecting a solution into the formation through a temporary injection well, the solution comprising a water-soluble tracer and a partitioning tracer that distributes between the formation oil and water; (2) essentially discontinuing injection into the temporary injection well after a slug of the tracer solution has been injected; (3) producing formation fluids from the production well; (4) monitoring the concentration of each tracer and the volumes of fluids produced from the producing well borehole; and (5) determining the formation residual oil saturation from the chromatographic separation of the water-soluble tracer and the partitionable tracer as indicated by the volume of fluids produced from the producing well borehole between the time the tracer solution is injected and the times at which the water-soluble and partitionable tracers are detected in the fluids produced from the producing well borehole.

Residual oil saturation is calculated from the volume of fluids produced from the producing well borehole between the times the concentrated tracer solution is injected and the time the maximum concentration of the water-soluble and partitionable tracers are detected in the fluids produced from the producing well borehole.

This process relies on the natural, or on production induced, movement of fluids to transport tracers across the formation into a sampling producer well. Application of this method provides a means whereby, (1) a relatively large segment of the formation may be tested with a minimal amount of tracers; (2) the normal oil production operations are not disrupted; and (3) waterflooding facilities are not required.

Determining the residual oil saturation by this method before a secondary or tertiary process is installed is a useful practice for eliminating candidate reservoirs that are unsuitable for such processes and for optimizing injection of expensive tertiary injectants.

BRIEF DESCRIPTION OF THE DRAWINGS

FIG. 1 is a plot of predicted tracer breakthrough for dipole injection and production of tracers, and for spot injection by the method of this invention.

FIG. 2 is a plot of predicted tracer location within a formation for dipole injection and production of tracer.

FIG. 3 is a plot of predicted tracer location within a formation for spot injection of the present invention.

DETAILED DESCRIPTION OF THE INVENTION

Figure 4:
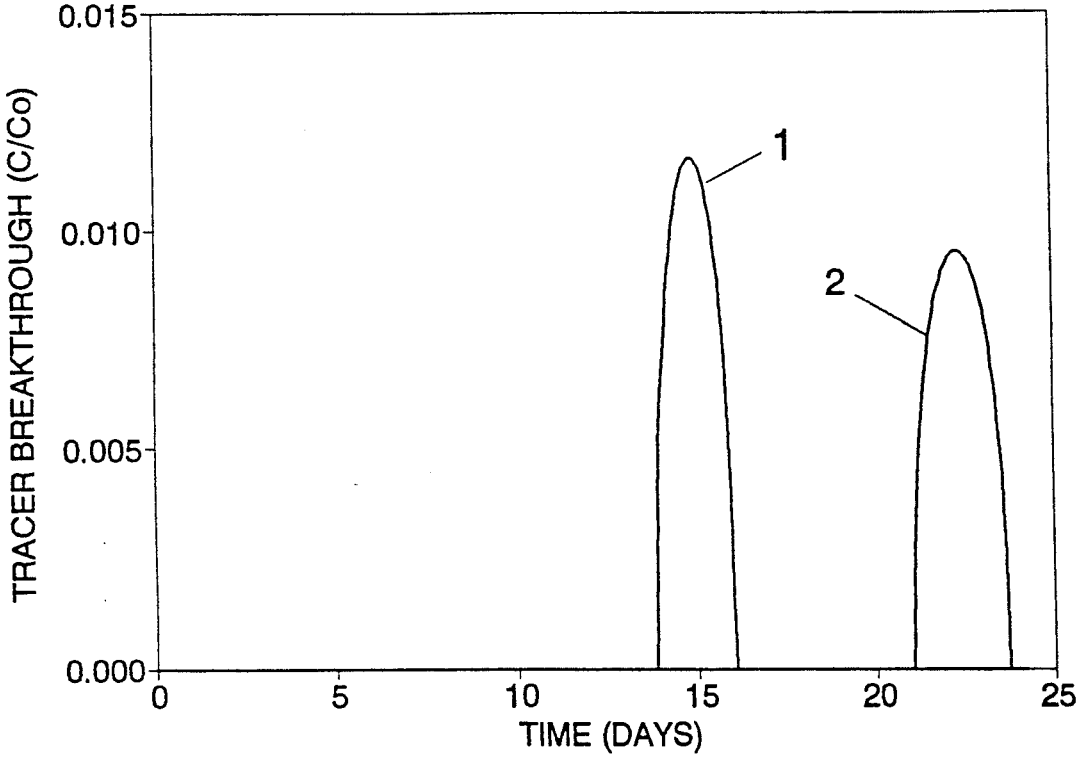
FIG. 4 is a plot of predicted tracer breakthrough for a water-soluble and a partitioning tracer.

The types of tracers which are acceptable include those that are utilized in the brine-driven tracer tests of the prior art, such as those disclosed in U.S. Pat. Nos. 3,590,923, 4,646,832, 4,617,994, 4,722,394, and 4,782,899, which are incorporated herein by reference.

Low concentrations of non-radioactive chemical tracers can be injected, provided the test is properly designed to recover a large fraction of the injected tracers at the production well.

The water-soluble tracer must be essentially insoluble in formation oil and must not interact with the solid mineral surfaces of the formation rock. The oil/water partitioning tracer should partition substantially into the oil. The preferred pair of tracers for interwell testing is a pH adjusted combination of sodium bicarbonate (—$HCO_3$) and carbonated water ($H_2CO_3$) in formation brine. In-situ methods for generation of these tracers have been employed for single well testing, U.S. Pat. Nos. 4,617,994 and 4,646,832. In the present application, the —$HCO_3$ and $CO_2$ tracers are pre-formed at the surface before injection. This is preferably accomplished by adding sodium bicarbonate and hydrochloric acid directly to formation brine in a surface tank. In order to detect small changes in concentration of these tracers at the producing well, it is important to use the actual formation water and to maintain the pH as closely as possible to that of the original water. Final adjustment of pH should be made with either hydrochloric acid or sodium hydroxide. The bicarbonate ion propagates as a completely water-soluble tracer and the $CO_2$ from the carbonated water propagates as a moderately partitioning ($K \approx 2$) tracer. The exact value of the partition coefficient is dependent on the formation water salinity, the formation temperature, and other factors.

Alternatively, lower alcohols such as methanol and ethanol are acceptable water-soluble tracers, as they do not partition into the crude oil in significant amounts. The water-soluble tracer may also be an ionic species such as sodium nitrate, sodium thiocyanate, or sodium bromide, all of which have a strong affinity for the aqueous phase. Generally, alcohols containing four or five carbon atoms are acceptable partitioning tracers. Hexanols and higher alcohols usually partition too strongly into crude oil under most reservoir conditions.

In the case of radioactive tracers, extremely low concentrations can be detected, and in some cases injected fluids can be used that are below concentrations permissible for unregulated handling. If radioactive tracers are used, a desirable combination would consist of: (1) a water-soluble tracer such as tritiated water or hexacyano-cobaltate, tagged with cobalt-57, and (2) a partitioning tracer, such as a secondary alcohol containing about four carbon atoms, tagged with carbon-14.

Partitioning tracers are selected to provide a convenient amount of lag in arrival time of these tracers compared to that of the water-soluble tracers. Arrival times of tracers, expressed as a "Retardation Factor" (P), is related to both the oil saturation ($S_o$), and partition coefficient (K):

Partition coefficient is defined:

$$K = \frac{c_o}{c_w} \quad [1]$$

where, $c_o$-concentration of tracer in oil, mass of tracer/-volume oil $c_w$-concentration of tracer in water, mass of tracer/-volume brine The retardation of the partitioning tracer, relative to the water-soluble tracer is described by the arrival times or arrival volumes of the tracers:

$$P = \frac{t_w}{t_p} = \frac{V_w}{V_p} \quad [2]$$

where,

P-retardation factor $t_w$-time of arrival of water-soluble tracer $t_p$-time of arrival of partitioning tracer $V_p$-volume of fluid produced at the time of arrival of the partitioning tracer $V_w$-volume of fluid produced at the time of arrival of the water-soluble tracer and, $$P = \frac{1}{1 + \left(\frac{S_o K}{1 - S_o}\right)} \quad [3]$$

where, $S_o$-oil saturation (fraction of pore volume)

According to equation 3, for expected oil saturations in the range of 0.2 to 0.3, partition coefficients in the range of one to three will result in a conveniently measurable difference in arrival times without extending the testing period an unreasonable time.

Tracer solution should be injected at no higher concentration than that needed to permit quantitative measurement at the producing well. Minimizing the tracer concentration is important when using alcohols or any other partitioning tracers, because high concentrations act as miscible flooding agents, which swell and mobilize the residual oil. As a rule-of-thumb, alcohol concentration preferably should be kept below about 0.5% of the injected solution.

In the practice of this invention, it serves no purpose to dilute the tracer at the producing wells by arrival of flow paths that do not contain tracer. Minimization of this dilution can be achieved by injecting the tracer into the injection well for a short period of time, shutting in the injection well, and producing continuously from a nearby well, such that the reservoir fluids and tracers are drawn to the producing well and captured there. In the present method, the tracer response observed at the producing well is described by the relationship:

$$c/c_o = \frac{\arctan\left(\sqrt{\left[\frac{4r_o^2 q_p t_p P}{\pi h \phi(1 - S_o)\left(r_o^2 - \frac{q_I t_I P}{\pi h \phi(1 - S_o)} + \frac{q_p t_p P}{\pi h \phi(1 - S_o)}\right)^2}\right] - 1}\right)}{180^\circ} \quad [4]$$

where, $c/c_o$-ratio of concentration-produced tracer/injected tracer $r_o$-distance from injection well to producer well $q_p$-production rate $q_I$-injection rate $t_p$-producing time to breakthrough of tracer at concentration $c/c_o$ $t_I$-injecting time h-thickness of formation Φ-porosity, pore volume/bulk volume The maximum concentration of tracer captured at the producer after a spot injection of a volume of tracer fluid is:

$$c/c_{omax} = \frac{\arcsin\left(\sqrt{\frac{q_I t_I P}{\pi h \phi(1 - S_o) r_o^2}}\right)}{180^\circ} \quad [5]$$

This response is considerably more favorable than that experienced with the previous methods in which tracers are driven to the producer by continuous injection into the tracer injector. FIG. 1 illustrates the difference in response of a spot injection compared to a two-well "dipole" with the injection rate equal to the production rate as described by Muskat in *Physical Principles of Oil Production*, (1949), p. 668. In FIG. 1, concentration of the injected tracer is plotted as a function of the pore volumes of production. The concentration profile for dipole injection, 1, and the and the concentration profile for spot injection, 2, are shown. In this example the spot volume is 0.001 pore volumes, where one pore volume is defined as the mobile fluid filled volume of the portion of the reservoir contained within a cylinder having a radius equal to the interwell distance ($r_o$). This can be calculated according to equation 6 below.

$$V = \pi r_o^2 h \Phi (1 - S_o) \quad [6]$$

For the case of constant production the horizontal scale in FIG. 1 can also be a measure of time.

$$V = q_p t \quad [7]$$

In the spot injection method of this invention, the breakthrough is sharp, the maximum concentration is high, and all the tracer is recovered after only slightly over one pore volume. By contrast, the tracer recovery from an injection/production dipole exhibits an early initial breakthrough (at 0.333 pore volumes), and tracer is dispersed to a low peak concentration. Only about 60% of the tracer is recovered after two pore volumes. The tracer is dispersed because it is pushed in all directions by the continuous injection. Consequently, many of the flow paths have long distances to travel.

FIG. 2 is a plan view of the formation illustrating positions of a 100-barrel 0.0089 pore volume slug of tracer during dipole flow. The tracer is injected at the injection well, 20, and is produced at the production well, 21. At the end of tracer injection the tracer front is located at, 22, and the tracer back is at the injection well, 20. Tracer breakthrough occurs at about 0.33 pore volumes and, after a cumulative 0.5 pore volumes of fluid have been produced from the producing well, the tracer remaining in the formation is spread in a thin band between the front, 23, and the back of the tracer bank, 24.

FIG. 3 is a plan view of a formation into which a spot tracer is injected through the injection well, 31, and produced with formation fluids at a production well, 32. The areal position of the tracer solution at the end of injection is indicated by 33; after 0.5 pore volumes of production the position is indicated by 35; and at the time of breakthrough, at 1.0 pore volumes, the position is indicated by 34.

Comparing FIGS. 2 and 3 highlights the unobvious advantage of spot injection of a tracer. With the spot injection as practiced in the present invention, the tracer is produced as a much sharper peak and at considerably reduced dilution, as shown in FIG. 1.

The manner of tracer production in the present invention permits injection of the tracer over a relatively short time, preferably no more than a few hours. This minimizes the amount of the tracers that must be initially injected. Depending on interwell distance, a slug of between about 10 and about 100 barrels containing both tracers is usually sufficient for tracers to be adequately measured in produced fluids. The tracer slug is preferably flushed out of the wellbore and into the formation by formation brine, but initially driving the slug any further into the formation is not necessary and is not preferred.

In cases in which the tracers are injected into multiple zones having different zonal pressures, it may be necessary to prevent cross flow in the well between layers after tracer injection is ended. This can be accomplished by mechanically isolating zones or by filling the well with a temporary viscous plugging agent immediately following the tracer injection. Driving the slug into the formation will tend to push the slug radially from the injection wellbore, and result in dilution of the tracers when they reach the producing wells. Thus, this practice reduces and broadens the peaks in tracer concentrations that are detected at production wellbores and is therefore not required, and not preferred.

A variation of the spot tracer injection method, which can be used to diminish crossflow and provide other advantages, consists of following the tracer injection with a continuous injection of formation brine at a low rate compared to the production rate at the tracer capture well. For example, if the continuous injection rate is maintained at 5% of the production rate, 90% of the tracer would be recovered after only 1.02 pore volumes. The injection of fluids at rates of about 10% of the rate that the producing well is producing will not significantly diminish the benefits of the present invention. Following the injection of tracers with such low rates of fluids therefore constitutes essentially discontinuing injection.

Shut-in production wells are often available in watered-out fields and can be used to spot the tracers within the formation according to this invention.

When using the spot tracer method, breakthrough of tracers will likely occur in only one well. Modeling reservoir fluid flows can be useful in deciding which production wells to monitor for the presence of tracers. These studies can be applied to avoid injection of tracer at a stagnation point of flow, wherefrom the tracer would not migrate to a monitor well; however, judicious selection of injection points will usually assure tracer arrival at the desired production well. Although modeling techniques are well known in the art, such modeling is not necessarily required because the present invention contemplates monitoring of multiple producing wells for the presence of tracer components. Flow pattern studies usually indicate that a small tracer spot will not appear in more than one producing well; however, if non-idealities should result in the tracers being produced at multiple production wells, residual oil saturations may be calculated for the region of the formation between the injection well, and each of the producing wells in which tracers are detected.

For determination of residual oil saturation two tracers having different partition coefficients must be injected. The tracers could be injected separately, either consecutively or separated by a time period, but it is preferable that the two tracers be injected in the same slug of solution and at the same time. Injecting the tracers separately creates a possibility that the tracers will traverse different flow paths within the formation due to different formation liquid production patterns. FIG. 4 illustrates the breakthrough tracer concentrations predicted by Equation 4 for a spot injection of two tracers, one water-soluble-only ($K=0$), and the other a partitionable tracer with equal solubility in the oil and the water ($K=1$).

The fluid saturations of the formation can be determined by standard chromatographic methods described in U.S. Pat. No. 3,623,842, incorporated herein by reference. Chromatography as applied to the flow of a tracer through a porous medium is well known and has been extensively studied. These methods use either arrival times or volumes of produced fluids. Arrival times of the tracers at some distant location in the formation from the original injection point may be used, provided the production rate remains constant throughout the duration of the test. A more reliable but less convenient technique is to use the volumes produced between the time of introducing the tracers into the formation and the time of detection at the producing borehole. Equation 8 relates oil saturation to the retardation factor, given in Equation 2, for a given partition coefficient:

$$S_o = \frac{1 - P}{1 + (K - 1)P} \qquad [8]$$

This solution assumes that the oil saturation is immobile and the oil cut is zero at the producer. In cases in which the oil is slightly mobile and the production well produces a small fraction of oil ($f_o$), a correction can be applied to the oil saturation that is calculated from Equation 8. The corrected oil saturation ($S_{op}$) may be expressed:

$$S_{op} = S_o + \Delta S \qquad [9]$$

where, $$\Delta S = \frac{PK}{\{1 + P(K - 1)\}\left\{1 + \frac{[1 + P(K - 1)]}{f_o(K - 1)}\right\}} \qquad [10]$$

and, $f_o$=volume of oil/volume of total fluids produced.

The partition coefficients, which are used in the chromatographic analysis, are ratios which describe the equilibrium distribution of a tracer between phases. These ratios, also known as distribution coefficients and equilibrium ratios, can be determined by simple experimental procedures. Where only two phases exist in the reservoir, a two-phase partition coefficient is determined for each tracer. Known quantities of water, reservoir oil, and the tracer are combined and vigorously agitated to ensure complete and uniform mixing of the three components. After the system has reached equilibrium at reservoir conditions and the carrier and immobile fluids have segregated, the concentration of the tracer in each of the fluid phases is determined. The ratio of these concentrations is the partition coefficient for that tracer in that fluid system. Alternatively, laboratory core flow experiments, in which oil saturation is known, can be used to measure the retardation factor, P, and thereby determine the partition coefficient using the relationship given in Equation 3.

Where oil, gas, and water coexist in the reservoir, three-phase partition coefficients must be determined if the method of this application is used to ascertain the relative saturations of all three fluids.

A minimum of two tracers are required to determine residual oil saturation by this invention. Two tracers can be used where only two fluids, oil-water or gas-water, exist in the reservoir or where three fluids are present and the saturation of one fluid is determined by independent means. However, even under these circumstances, more than two tracers may be employed. A third tracer with a partition coefficient which differs from those of the other tracers would give additional comparative information. The analysis of the results is quite naturally more complex when three tracers are used to determine the saturations of three formation fluids. However, one skilled in the art can readily determine these saturations by applying the principles of chromatography in accordance with the teaching of this application.

The ion content of the carrier fluid itself may serve as one of the two required tracers if it can be satisfactorily distinguished from the mobile phase which it displaces. For example, chloride ion might be added to the formation brine being injected to increase the concentration of chloride already present. Alternatively, fresh water might be added to the formation brine in order to use the decrease in chloride ion concentration as the tracer pulse.

The produced fluids can be analyzed for the presence of the tracers in any convenient manner. Conventional chemical analytical techniques, such as qualitative-quantitative methods, conventional chromatographic methods and the like, can be employed. For radioactive isotope tracers, arrival times may be determined with standard radiological methods, using gamma counters or beta scintillation counting devices.

Hypothetical Example

As an example of the application of the spot tracer injection method for determining residual oil saturation, an oil reservoir having the following properties and the following test conditions will be utilized:

formation thickness-10 feet
formation porosity-0.2
fractional oil flow-0.0
brine tracer injection rate-500 barrels/day
brine tracer production rate-500 barrels/day Ten barrels of formation brine, containing a water-soluble (K=0) tracer, 1, and an oil/water partitioning (K=1) tracer, 2, will be injected into the injection well, which is located 100 feet from the producing well.

Injection of the tracer slug will require about one-half hour. For an ideal displacement in a reservoir containing an immobile oil saturation equal to 0.333, Equation 4 predicts the first arrival of the water-soluble tracer, 1, will occur after 13.9 days. Tracer production response is illustrated in FIG. 4. According to equations 4 and 5, the water-soluble tracer concentration will peak one day later (14.9 days), at a value equal to 1.17% of the injected tracer concentration, and will sweep out to zero concentration after 16 days of elapsed time. To detect a breakthrough concentration of 50 parts per million at the producing well, the injected tracer fluid slug will need to contain about 0.4% active ingredient.

The oil/water partitionable tracer, 2, will lag the advance of the water-soluble tracer according to Equation 3. With an oil saturation of 0.333 and a partition coefficient of 1.0, the retardation factor is calculated to be 0.666. That is, the arrival time of the partitioning tracer would be 1.5 times that of the water-soluble tracer. Equation 4 predicts that the first arrival of the partitioning tracer, 2, will occur after 21.1 days, will peak after 22.4 days at 0.95% of the injected concentration, and will sweep out after 23.7 days.

The oil/water partitionable tracer, 2, will lag the advance of the water-soluble tracer according to Equation 3. With an oil saturation of 0.333 and a partition coefficient of 1.0, the retardation factor is calculated to be 0.666. That is, the arrival time of the partitioning tracer will be 1.5 times that of the water-soluble tracer. Equation 4 predicts that the first arrival of the partitioning tracer, 2, will occur after 21.1 days, will peak after 22.4 days at 0.95% of the injected concentration, and will sweep out after 23.7 days.

Figure 5:
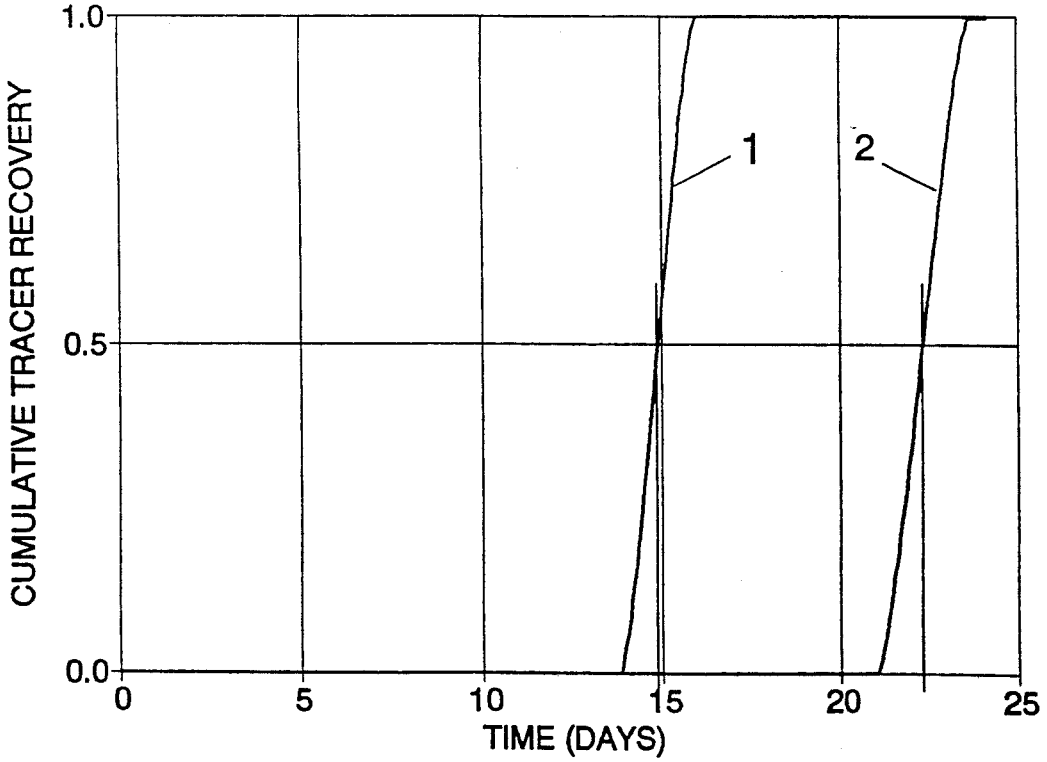
FIG. 5 is a plot of cumulative tracer recoveries as a function of producing time.

Ordinarily, the observed arrival times of the peak concentrations are used to determine the residual oil saturation by the relationships given in Equations 2 and 8. A preferred method of analysis uses the integrated area behind the cumulative tracer recovery as a function of the cumulative production to evaluate the retardation factor. This is illustrated in FIG. 5. Using the entire tracer production to determine the average breakthrough time is advantageous in field tests in which the concentration data are imprecise and random errors conceal the exact position of peak values. In addition, the integrated area analysis obtains the oil saturation of individual layers, since the real streamline flow paths are almost coincident when the spot tracer injection method is applied, and time of arrival of tracers is largely dependent upon layer permeabilities.

We claim:

1. A method to determine the residual oil saturation of an oil-bearing formation having a temporary injection well through which a tracer solution can be inserted into the formation and a fluid production well, wherein production from the production well induces formation fluids to flow from the formation in the vicinity of the injection well comprising the steps of:

(1) injecting a tracer solution into the formation through the temporary injection well, the solution comprising a water-soluble tracer and a partitionable tracer that distributes between the formation oil and water;

(2) essentially discontinuing injection into the temporary injection well after a slug of tracer solution is injected;

(3) producing formation fluids from the production well;

(4) monitoring the concentration of each tracer and the volumes of fluids produced from the producing well borehole; and (5) determining the formation residual oil saturation from the chromatographic separation of the water-soluble tracer and the partitionable tracer as indicated by the volume of fluids produced the producing well borehole between the time the tracer solution is injected and the times the water-soluble and partitionable tracers are detected in the fluids produced from the producing well borehole.

2. The method of claim 1 wherein a plurality of producing wells are monitored for the presence of the tracers and the residual oil saturation is determined from the data for any producing well in which tracers are detected.

3. The method of claim 1 wherein the water-soluble tracer is a pH adjusted sodium bicarbonate additive in the formation water.

4. The method of claim 1 wherein the partitionable tracer is pH adjusted carbon dioxide in formation water.

5. The method of claim 1 wherein the concentrated solution of tracers is displaced from the wellbore by an aqueous brine before injection into the injection wellbore is discontinued.

6. The method of claim 1 wherein the concentrated tracer solution is injected for a time period sufficient to occupy less than 10% of the pore volume of the formation contained in a cylinder of the height of the formation, and a radius equal to the interwell distance.

7. The method of claim 6 wherein the concentrated tracer solution is displaced from the injection well borehole by following the concentrated tracer solution with less than about two wellbore volumes of brine.

8. The method of claim 1 wherein the water-soluble tracer is an excess or a deficiency of bicarbonate ion in the formation brine.

9. The method of claim 1 wherein a plugging solution is injected into the well after the tracer has been injected.

10. A method to determine the residual oil saturation of an oil-bearing formation having a temporary injection well through which a tracer solution can be inserted into the formation and a fluid production well producing fluids at a production rate, wherein production from the production well induces formation fluids to flow from the formation in the vicinity of the injection well comprising the steps of:

(1) injecting a tracer solution into the formation through the temporary injection well, the solution comprising a water-soluble tracer and a partitionable tracer that distributes between the formation oil and water;

(2) injection of fluid into the temporary injection well after a slug of tracer solution is injected at a rate of about 10 percent or less of the production rate;

(3) producing formation fluids from the production well;

(4) monitoring the concentration of each tracer and the volumes of fluids produced from the producing well borehole; and (5) determining the formation residual oil saturation from the chromatographic separation of the water-soluble tracer and the partitionable tracer as indicated by the volume of fluids produced from the producing well borehole between the time the tracer solution is injected and the times the water-soluble and partitionable tracers are detected in the fluids produced from the producing well borehole.

* * * * *